US005354226A

United States Patent [19]

Ruppert

[11] Patent Number: 5,354,226

[45] Date of Patent: Oct. 11, 1994

[54] HAND PUPPET WITH TWO EYE SPHEROIDS CONNECTED BY CORD

[76] Inventor: David F. Ruppert, Clark Rd., Cape Neddick, Me. 03902

[21] Appl. No.: 132,189

[22] Filed: Oct. 6, 1993

[51] Int. Cl.[5] ..... A63H 3/14; A63H 33/00

[52] U.S. Cl. ..... 446/328; 446/26

[58] Field of Search ..... 446/26, 268, 327, 328, 446/329, 392; D21/152, 153

[56] References Cited

U.S. PATENT DOCUMENTS

| | | | |
|---|---|---|---|
| 926,784 | 7/1909 | Trimbur | 446/328 |
| 984,414 | 2/1911 | Black | 446/328 |
| 1,143,808 | 6/1915 | Choate | 446/328 |
| 1,437,406 | 12/1922 | Druzbach | 446/328 |
| 3,613,301 | 10/1971 | Noble et al. | 446/327 |
| 4,276,715 | 7/1981 | Rogers | 446/329 |

FOREIGN PATENT DOCUMENTS

| | | | |
|---|---|---|---|
| 617484 | 2/1927 | France | 446/328 |
| 771 | 2/1892 | United Kingdom | 446/328 |
| 28645 | 12/1896 | United Kingdom | 446/328 |

*Primary Examiner*—Robert A. Hafer
*Assistant Examiner*—Jeffery D. Carlson
*Attorney, Agent, or Firm*—Steven G. Saunders

[57] ABSTRACT

A hand puppet in which two spheroids, each having an eye illustration upon their faces, are utilized to represent the puppet's eyes, and a flexible or rigid cord is used to connect the eyes and operate the puppet. Additional humanhold features such as a mouth, mustache, eyebrow, tongue, or hair can also be utilized.

2 Claims, 7 Drawing Sheets

HAND PUPPET WITH TWO EYE SPHEROIDS CONNECTED BY CORD

FIELD OF THE INVENTION

This invention relates generally to an apparatus that can be utilized as a toy, and more particularly concerns a hand puppet that can be used as a toy and as a means of communication and education.

BACKGROUND OF INVENTION

Puppets have frequently been used to convey the image of a character or individual in one on one contact between an adult and a child. Such a device is generally used so that the child feels that she is talking to an individual who is not an adult. This contact encourages a more candid response by the child to questions and comments from the puppet who plays the alter ego of its operator. Educators, psychologists, and others similarly use puppets to convey important messages to children and to get them to discuss sensitive sociological issues, such as sexual and physical abuse, divorce, etc...

Puppets ordinarily take the form of a fabric hand covering with features affixed to the outside of the fabric. Such features include eyes, nose, mouth, and other humanoid features. These puppets constrain the hand within the fabric and thus limit the utility of the hand and fingers of the person operating the puppet.

Puppets also take the form of a paper cut-out doll glued to a stick. This type of puppet similarly constrains the utility of the operator's hand and fingers.

Accordingly, there is a need for a hand puppet that can be utilized as a toy, does not constrain the operator's hands and fingers, and can be used as an aid for communication between adults, children, or other people.

SUMMARY OF INVENTION

It is therefore an object of this invention provide a hand puppet for use as a toy.

It is another object of this invention to provide a hand puppet that can encourage candid communication between adults, children, or other people.

It is a further object of this invention to provide a hand puppet that does not unnecessarily constrain the hand and fingers of its operator.

It is also an object of this invention to provide a hand puppet that is simple to operate.

It is yet another object of this invention to provide a hand puppet that is simple to manufacture.

It is still an object of this invention to provide a puppet that is capable of easily changing its appearance.

This invention results from the realization that a hand puppet can be designed from two or three simple objects, and not unnecessarily constrain the operator's hand. Such a puppet can be used to encourage candid communication between adults, children or other people.

The hand puppet includes at least two spheroids each having an eye illustration upon their faces. There is a means for connecting the spheroids that can be either a rigid or flexible cord. The hand puppet further has a means for mounting an additional component to the spheroids. The additional component includes a mouth, a mustache, an eyebrow, a tongue, and hair. The flexible cord is fastened and inserted through a hole defined by the face of the spheroids.

The hand puppet is alternatively made of only one spheroid having an eye illustration upon its face. A post extends from the object so that the puppet can be operated by a user. The post can be either rigid or flexible. A means for mounting additional components to the spheroid is also utilized. Additional components include a mouth, a mustache, an eyebrow, a tongue, and hair.

DISCLOSURE OF PREFERRED EMBODIMENT

Other objects, features, and advantages of this invention will occur to those skilled in the art from the following description of a preferred embodiment and the accompanying drawings, in which:

Turning first to FIG. 1, there is shown a hand puppet with two eyes and a flexible connective cord.

Figure 1:
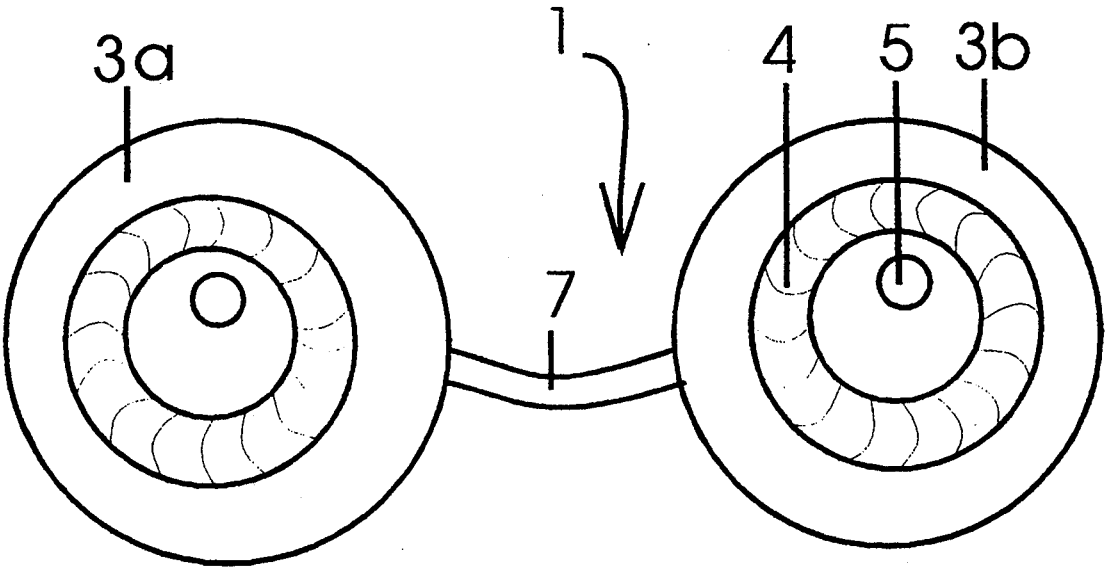

There is shown in FIG. 1 a hand puppet 1 having two eyes 3*a* and 3*b*. Although eyes 3*a* and 3*b* can be shaped into an ellipsoid, they can take on any geometric shape, such as a sphere, pyramid, etc. . . In the preferred embodiment, eyes 3 are shaped spherically and are connected by a flexible connective cord 7. Eyes 3*a* and 3*b* have some form of eye illustration or protrusions that represent the makeup of eyes 3*a* and 3*b* such as pupil 5, iris 4, or the like painted or glued upon its face. If pupil 5 is glued upon its face, some external attachment is molded, colored, etc... into the form of pupil 5, iris 4, or the like.

Eyes 3*a* and 3*b* can be made of plastic, metal, stainless steel, or some other material that can be manufactured to perform the required functions. Flexible connective cord 7 can be made of any flexible material, including plain fabric fibers, fabric having rubber fibers, plastic, or other elastic/rubber, petroleum based products.

Figure 2:
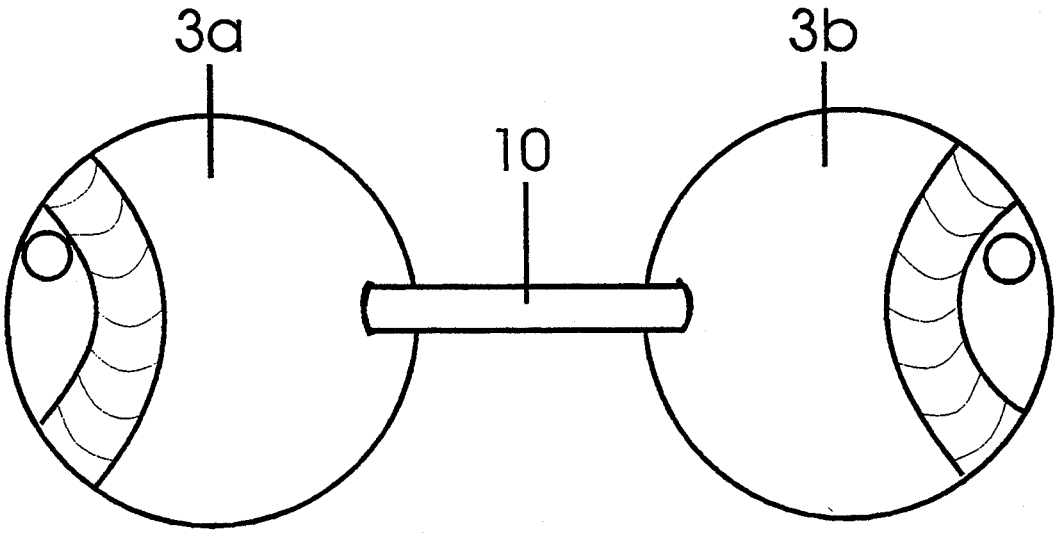
FIG. 2 shows a hand puppet with two eyes and a rigid connective cord.

As shown in FIG. 2, hand puppet 1 can utilize a rigid connective cord 10 in place of flexible connective cord 7. Rigid connective cord 10 can be made of any rigid plastic, flexible metal, or similar material having a limited malleability. This allows the operator to use puppet 1 for various other applications.

Figure 3:
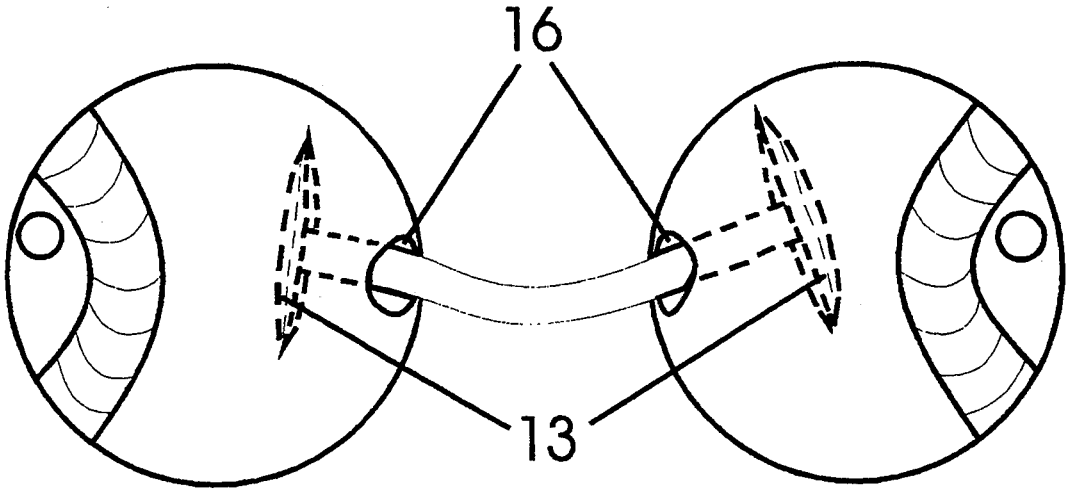
FIG. 3 shows a back view of a hand puppet with two eyes. The connective cord is fastened through holes defined by the eyes.

As detailed in FIG. 3, flexible cord 7 or rigid cord 10 can connect eyes 3*a* and 3*b* through a hole 16 defined by each of eyes 3*a* and 3*b* respectively. A fastener 13, which can be disposed either internal or external to the surface of eye 3 near hole 16, is utilized to fasten flexible cord 7 or rigid cord 10 within of hole 16.

Figure 4:
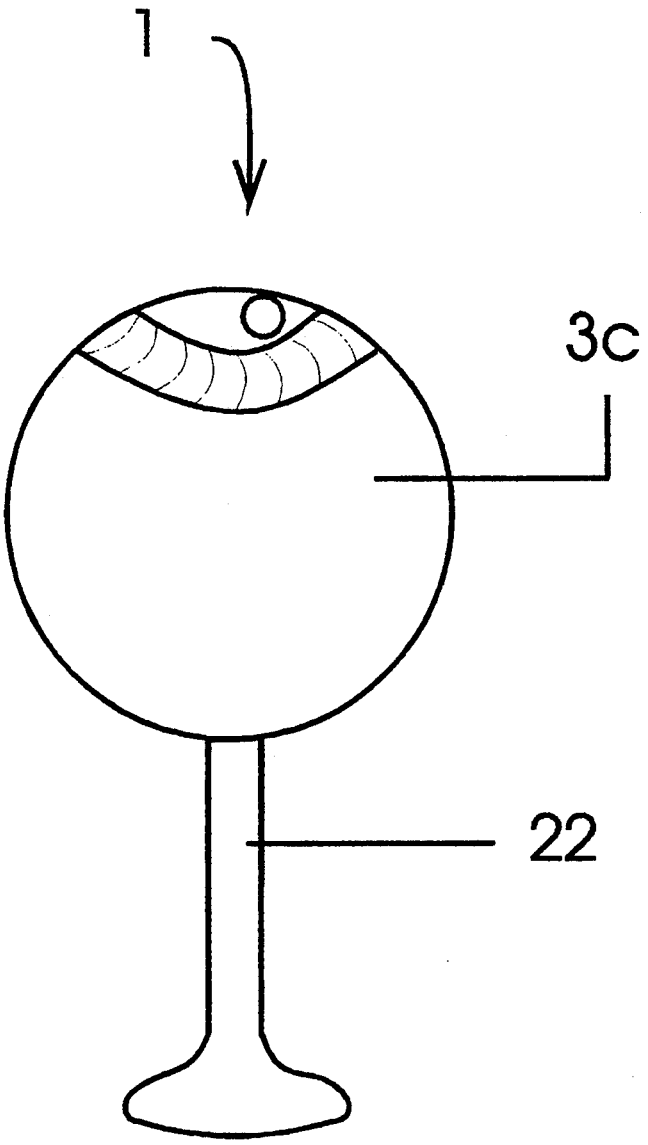
FIG. 4 shows a hand puppet with one eye and a post extending from the face of the eye.

FIG. 4 shows an alternate embodiment of puppet 1 utilizing only one eye 3*c*. Eye 3*c* has the same pupil 5/iris 4 or the like illustration or protrusion upon its face with a post 22 extending from a face generally opposite eye illustration pupil 5/iris 4. Post 22 can be either rigid or flexible, and be made of the same materials as flexible cord 7 or rigid cord 10.

Figure 5:
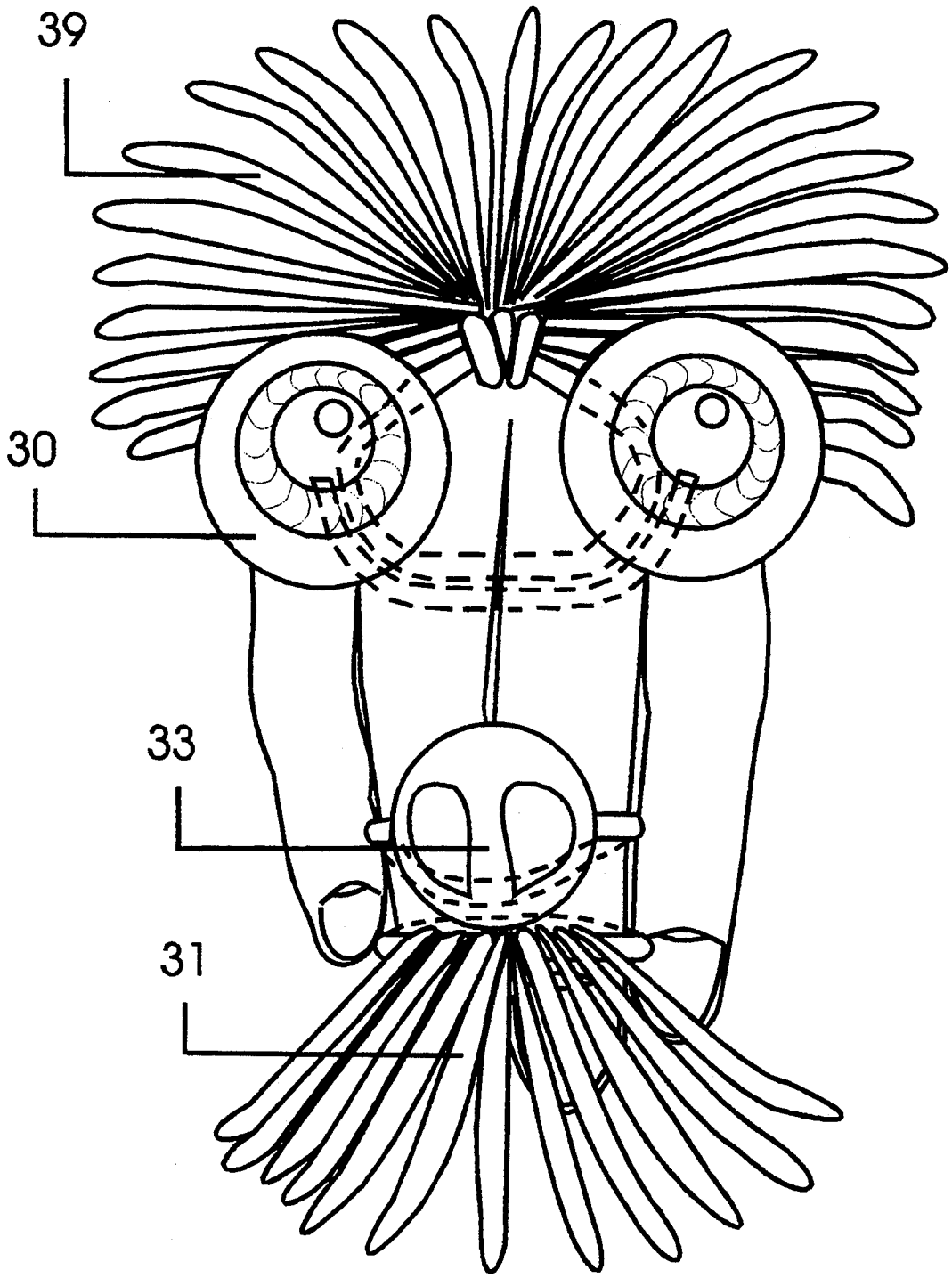
FIG. 5 shows a hand puppet with two eyes being utilized with an operator's hand.
Figure 6:
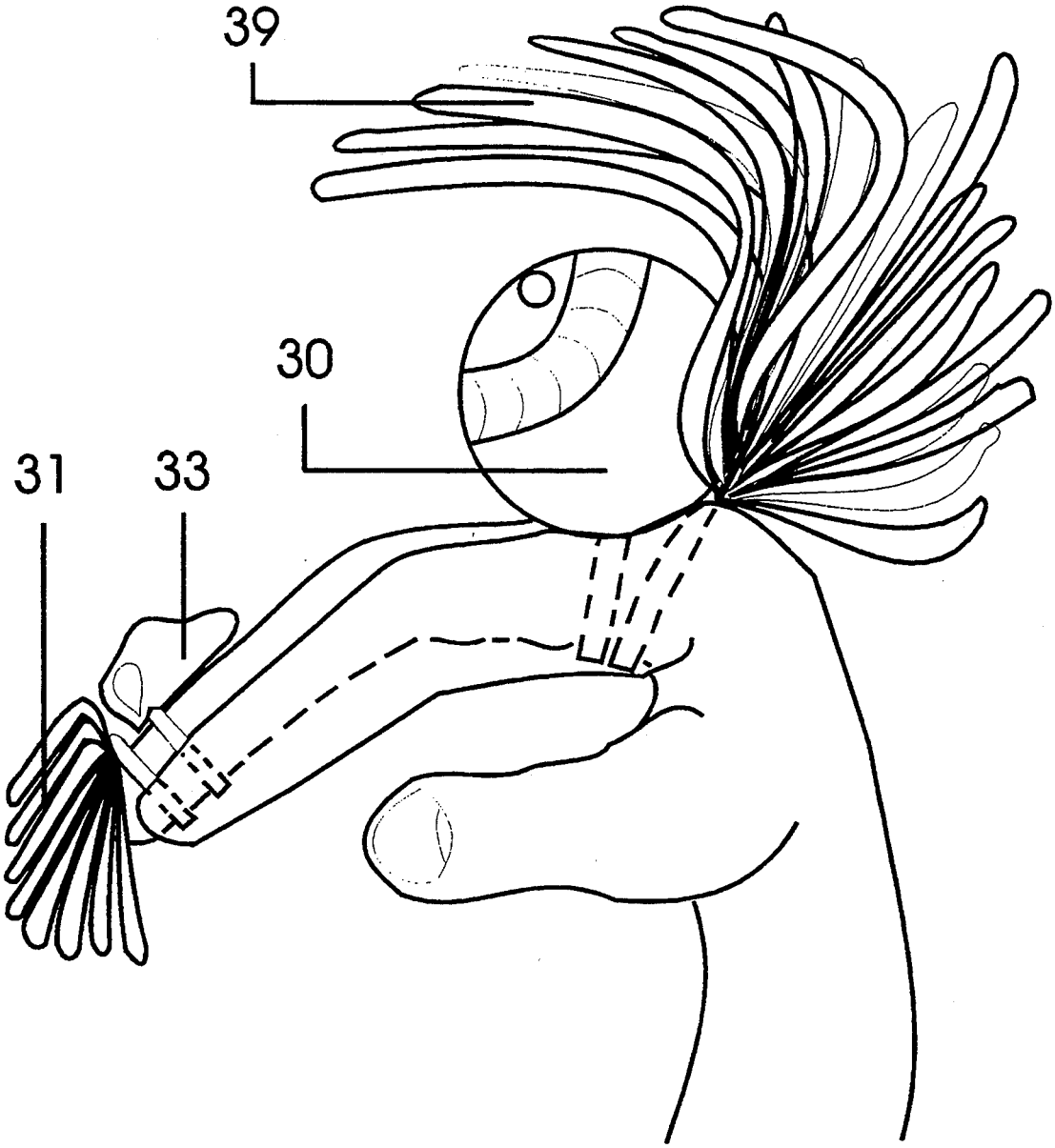
FIG. 6 shows a side view of a hand puppet with one eye being utilized with an operator's hand.
Figure 7:
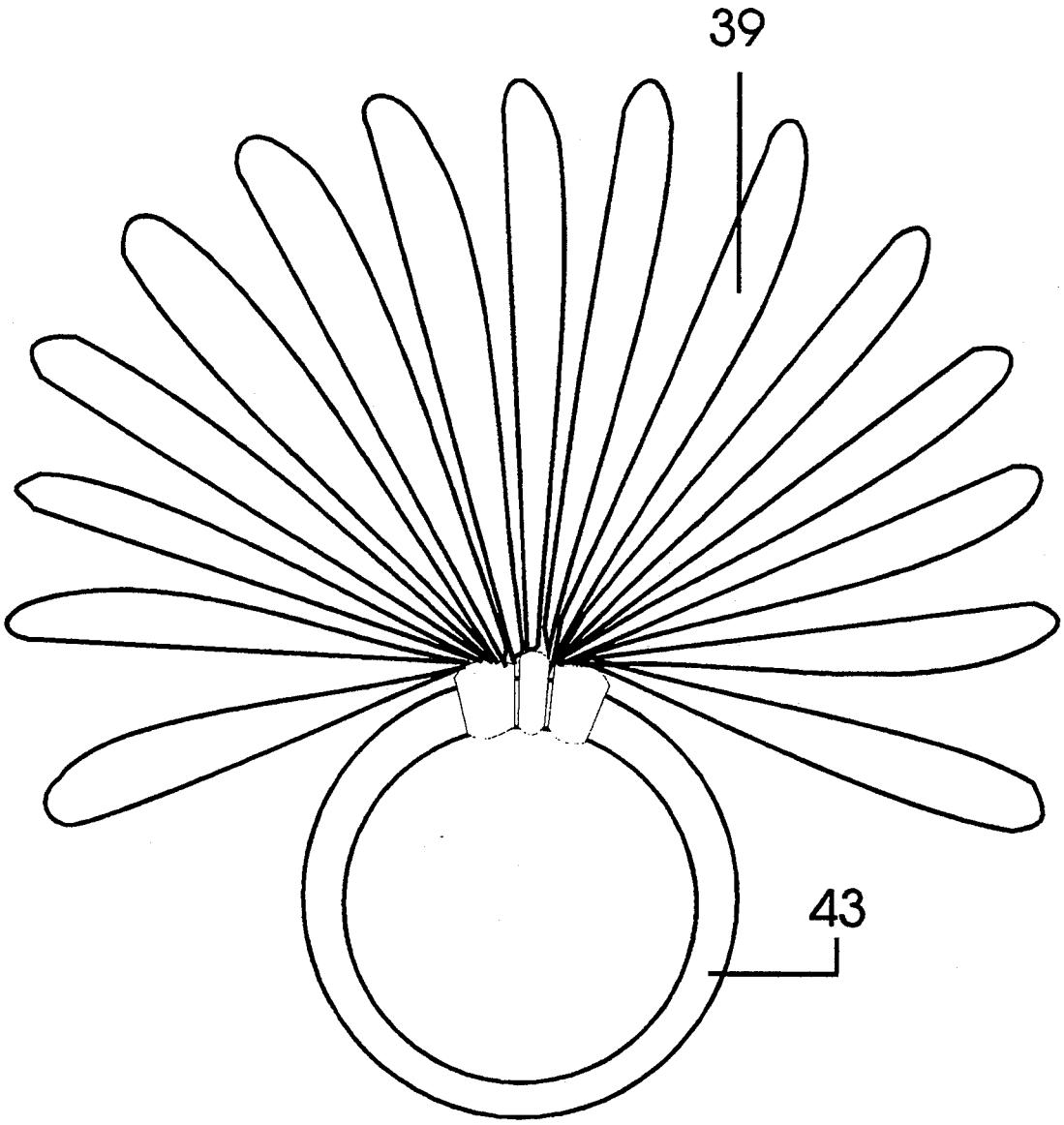
FIG. 7 shows a mechanism that allows a hand puppet to add features, such as hair shown in the figure.

FIG. 5 demonstrates one use of the preferred embodiment of puppet 1 with two eyes 3*a* and 3*b*. FIG. 6 similarly demonstrates one of many possible operations puppet 1 with one eye 3c. Both figures demonstrate the use of additional humanoid parts for the puppet. These parts, which can be used individually or collectively, include hair 39, eyebrows 36, nose 33, mustache 31, mouth 28, and tongue 25. These additional parts, which can be made from any conventional material known in the art, can be attached to puppet 1 by conventional clip on and attachment techniques. FIG. 7 shows the use of a ring 43 that is used to clip on additional parts hair 39, eyebrows 36, nose 33, etc. . . Ring 43 can similarly be manufactured of any flexible material, including plain fabric fibers, fabric having rubber fibers, plastic, or other elastic /rubber, petroleum based products. An elastic band can be utilized to perform the same function. Ring 43 is either attached to rigid connective cord 10, flexible connective cord 7, or aligned directly next to either of said connective cords 7 and 10.

Puppet 1 can be utilized as a toy for entertainment, education, or simply pleasure. Educators, psychologists, and the like can use puppet 1 as a method of encouraging children or others to be more candid with their thoughts and feelings regarding various social and moral issues. It thus educates and acts as a tool for child development. Furthermore, puppet 1 can be used as a specialized character to simply carry a message to children. Eyes 3a and 3b of puppet 1 are used to depict the personality or soul of a real or fictitious character.

Puppet 1 is preferably used by placing cord 7, cord 10, or post 22 between the operator's fingers. The operator's fingers are thus not constrained and can be used to portray other features of the character being portrayed by puppet 1. Such other features can be added to puppet 1 by attaching the other features to ring 43.

Although specific features of this invention are shown in some drawings and not others, this is for convenience only as some feature may be combined with any or all of the other features in accordance with this invention.

Other embodiments will occur to those skilled in the art and are within the following claims:

What is claimed is:

1. A method of making a hand puppet upon a human hand having an index finger, a middle finger, a ring finger, a pinkie finger, and a thumb, comprising the steps of:

wrapping a flexible cord under both the middle finger and the ring finger of the hand such that said cord is substantially hidden from a front view and at least seventy five percent of the length of the cord is substantially perpendicular to the fingers, said cord connecting a first spheroid and a second spheroid that each have an eye illustration upon their respective faces;

extending said first spheroid above and between the middle finger and the index finger;

extending said second spheroid above and between the ring finger and the pinkie finger;

extending the fingers of the hand substantially straight;

attaching a ring with a mustache connected thereto around both the middle finger and the ring finger, between said flexible cord and the fingertips of said finger; and attaching a ring with scalp hair connected thereto around both the middle finger and the ring finger, between said flexible cord and the base of said fingers.

2. A method of using a hand puppet with a human hand, said hand having an index finger, a middle finger, a ring finger, a pinkie finger, and a thumb, said hand puppet comprising a first spheroid, a second spheroid, said spheroids each having an eye illustration upon the faces thereof, a flexible cord that connects said spheroids, and a ring connected to scalp hair, the method comprising the steps of:

wrapping said flexible cord under both the middle finger and the ring finger of the hand such that said cord is substantially hidden from a front view and at least seventy five percent of the length of said cord is substantially perpendicular to the fingers;

extending said first spheroid above and between the middle finger and the index finger;

extending said second spheroid above and between the ring finger and the pinkie finger;

extending the fingers of the hand substantially straight;

attaching said ring with scalp hair connected thereto around both the middle finger and the ring finger, between said flexible cord and the base of said fingers; and moving the hand to simulate life in said puppet.

* * * * *